US007477025B2

(12) United States Patent
Teng

(10) Patent No.: US 7,477,025 B2
(45) Date of Patent: Jan. 13, 2009

(54) POWER CONTROL CIRCUIT FOR ADJUSTING LIGHT

(75) Inventor: Chih-Jen Teng, Taoyuan Hsien (TW)

(73) Assignee: FSP Technology Inc., Taoyuan Hsien (TW)

( * ) Notice: Subject to any disclaimer, the term of this patent is extended or adjusted under 35 U.S.C. 154(b) by 0 days.

(21) Appl. No.: 11/790,002

(22) Filed: Apr. 23, 2007

(65) Prior Publication Data

US 2008/0258652 A1 Oct. 23, 2008

(51) Int. Cl.
*G05F 1/00* (2006.01)

(52) U.S. Cl. ..... 315/307; 315/291; 315/209 R

(58) Field of Classification Search ..... 315/209 R, 315/210–212, 219, 224, 225, 226, 246, 247, 315/250, 254, 276, 283, 287, 291, 299, 307
See application file for complete search history.

(56) References Cited

U.S. PATENT DOCUMENTS 5,612,594 A * 3/1997 Maheshwari ..... 315/224
6,121,734 A * 9/2000 Szabados ..... 315/291
6,153,962 A * 11/2000 Noma et al. ..... 310/316.01
6,320,329 B1 * 11/2001 Wacyk ..... 315/291
6,703,796 B2 * 3/2004 Che-Chen et al. ..... 315/291
6,979,959 B2 * 12/2005 Henry ..... 315/291
2007/0103093 A1 * 5/2007 Hagen et al. ..... 315/291
2008/0024075 A1 * 1/2008 Henry ..... 315/307

* cited by examiner

*Primary Examiner*—Douglas W. Owens
*Assistant Examiner*—Jimmy T Vu
(74) *Attorney, Agent, or Firm*—Muncy, Geissler, Olds & Lowe, PLLC

(57) ABSTRACT

The present invention discloses a power control circuit for adjusting light, which adopts both frequency modulation and amplitude modulation for the control and starts using the amplitude modulation control after the frequency change exceeds a predetermined limit range, such that the voltage and frequency for driving the lamp set fall within a range acceptable to the lamp set and minimize the effect of frequency interferences.

9 Claims, 5 Drawing Sheets

POWER CONTROL CIRCUIT FOR ADJUSTING LIGHT

FIELD OF THE INVENTION

The present invention relates to a power control circuit for adjusting light, and more particularly to a control circuit using both frequency modulation and amplitude modulation to change an output current to adjust the brightness of a light source.

BACKGROUND OF THE INVENTION

The major components of a liquid crystal display (LCD) panel include a polarizer and a backlight module. The backlight module is provided for emitting light required by screen, and thus adjusting the brightness of a screen of an LCD panel is the same as adjusting the brightness of the light emitted by the backlight module. The brightness of the backlight module is controlled by current. The larger the current, the higher is the brightness. Referring to FIG. 1 for a circuit for adjusting the current of a backlight module, the circuit comprises a light adjusting signal source 1, a pulse controller 2, a switch 5, a power source 4, a transformer 6, a lamp set 7 and a sampling unit 3 for collecting and sending a feedback signal from the lamp set 7 to the pulse controller 2. The switch 5 controls the power source 4 to be supplied to a secondary side of the transformer 6, wherein the switch 5 includes a primary switch 51 and a secondary switch 52, and the duty cycles of both switches 51 and 52 are alternated, and a working voltage is generated at a secondary side of the transformer 6, such that the lamp set 7 is turned on by a voltage difference to emit light. The key of controlling the working voltage resides in that the pulse controller 2 provides a duty cycle signal for the operation of the switch 5, and the pulse controller 2 primarily bases on a voltage reference signal and a frequency reference signal, and the voltage reference signal produced by combining the feedback signal and a light adjusting signal that produces the light adjusting signal source 1. Referring to FIG. 1 for a circuit block diagram of a conventional amplitude modulation adjusting circuit, the frequency reference signal is generated primarily by connecting a capacitor to the pulse controller 2. Since the capacitance of the capacitor is constant, the charge/discharge time is constant, and the frequency reference signal as shown in FIG. 1 has a constant frequency. The voltage reference signal can be adjusted to change the duty cycle of the switch 5 to achieve the light adjusting effect, but the change of duty cycle of the switch 5 also gives a longer dead time between the duty cycles of the primary switch 51 and the secondary switch 52. As a result, zero voltage switching cannot be achieved, and losses occur. In another conventional frequency modulation adjusting circuit, the voltage is maintained constant and the operating frequency of the switch 5 is changed to achieve the light adjusting effect, but brightness of the lamp set 7 will be too low and the life expectancy of the lamp set 7 will be reduced, if the power frequency of the lamp set 7 is either higher or lower than the operating frequency of the lamp set 7. Furthermore, frequency interference (an interference with other frequencies of the panel) is produced at a high-frequency operation. As a result, the range of frequency change of the frequency modulation adjusting circuit is limited and the control range is limited, and a general user may feel that adjusting capacity is not as good, and a frequency interference (or a waveform with funny interferences will appear on the screen) may be produced easily, and the aforementioned two control method still require further improvements.

SUMMARY OF THE INVENTION

In view of the shortcomings of the aforementioned two ways of controlling a backlight module working voltage, the primary objective of the present invention is to provide a circuit of using the two methods sequentially to achieve the effects of providing a sufficient control range and overcoming the shortcomings of the prior art.

The present invention relates to a power control circuit for adjusting light, and the power control circuit simultaneously uses frequency modulation and amplitude modulation methods, and changes to use the amplitude modulation method if the frequency change exceeds a predetermined limit range, such that the voltage and frequency for driving the lamp set can fall within their ranges acceptable by the lamp set to prevent the frequency interference issue. A duty cycle of a switch in accordance with the present invention is used for controlling a power source and outputting a voltage to a lamp set through a transformer. The present invention comprises a sampling unit, a light adjusting signal source, an adjusting unit, a frequency modulation circuit, and a pulse controller, wherein the sampling unit obtains a feedback signal from a secondary side of the transformer, and the feedback signal and a brightness setting signal provided by the light adjusting signal source are combined to form an adjusting signal, and the adjusting signal is transmitted to the adjusting unit, and the adjusting unit has a standard voltage source for producing a standard voltage that is compared with the adjusting signal. A frequency modulation circuit is turned on according to the intensity of the adjusting signal, and the frequency modulation circuit is comprised of the frequency limiter and the frequency generator. The frequency reference signal is limited in a specific range for the adjustment. If the frequency of the frequency reference signal has reached a threshold set by the frequency limiter, then the adjusting signal divides the voltage to form a voltage reference signal, such that the pulse controller can use the frequency modulation circuit and the voltage reference signal to generate a duty cycle of the switch to adjust the brightness of the lamp set.

DETAILED DESCRIPTION OF THE PREFERRED EMBODIMENTS

The present invention will now be described in more detail hereinafter with reference to the accompanying drawings that show various embodiments of the invention.

Figure 1:
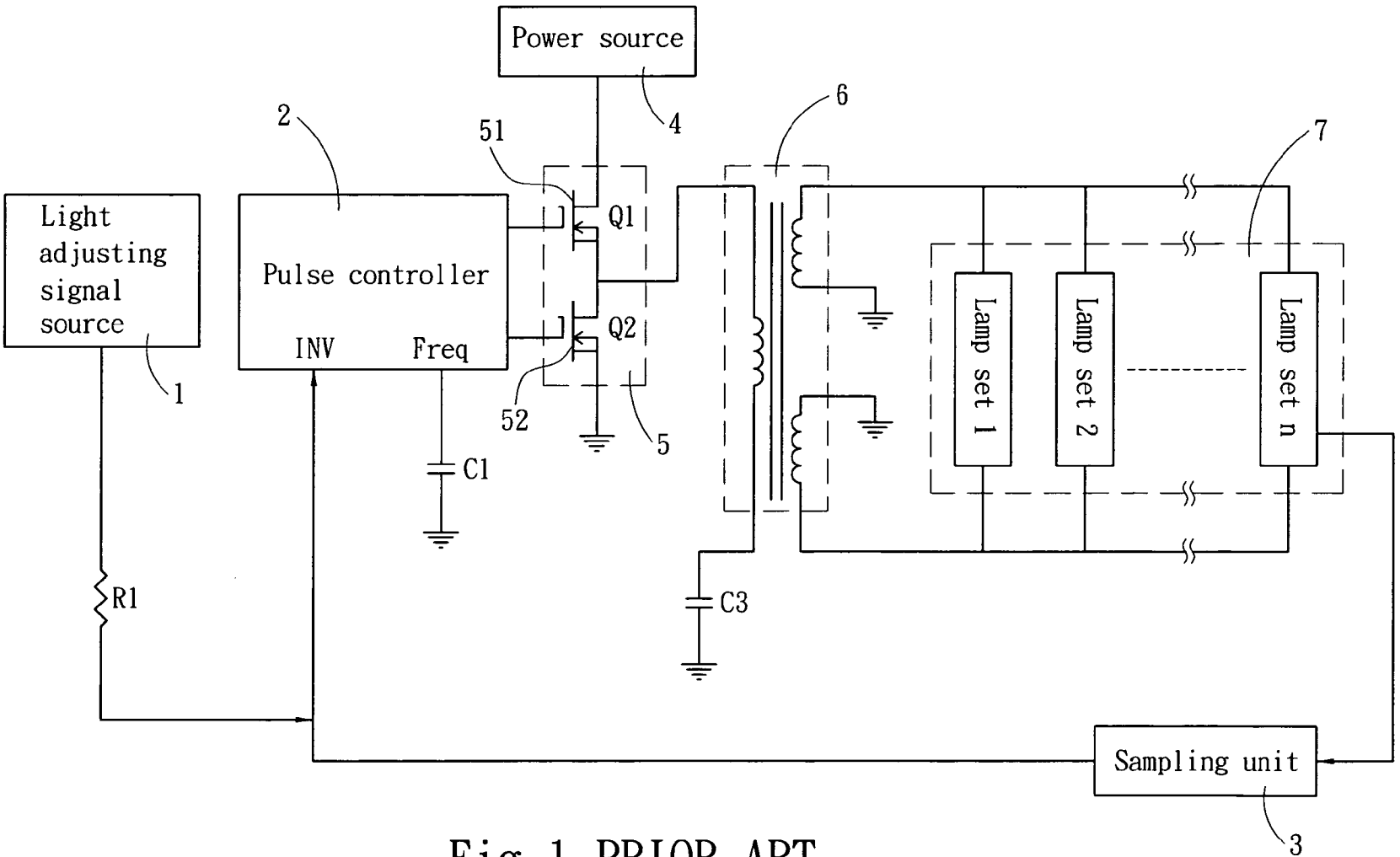
Fig. 1 PRIOR ART
FIG. 1 is a circuit block diagram of a conventional amplitude modulation adjusting circuit.
Figure 2:
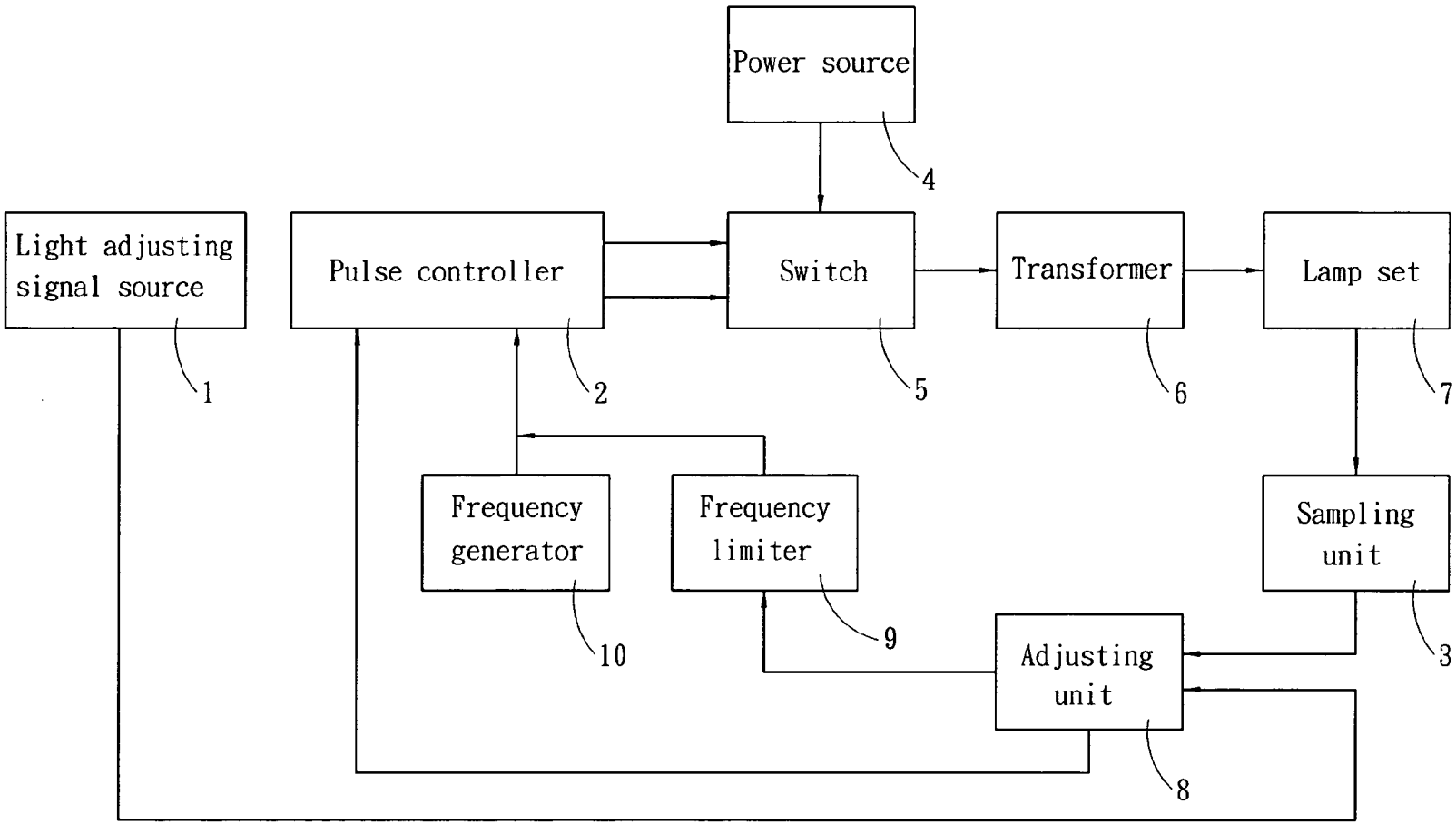
FIG. 2 is a circuit block diagram of the present invention.

The present invention relates to a power control circuit for adjusting light, and the power control circuit is applied for a duty cycle correction of an inverter. The inverter includes a pulse controller 2 for providing a duty cycle, a power source 4 for supplying power for adjusting the light provided by the inverter, a switch 5 that uses the duty cycle to determine the connection of the power source 4, and a transformer 6 outputs power from the power source 4 for driving a rear-end load according to a duty cycle, wherein the duty cycle is corrected according to the using state of the transformer 6 or the load feedback power, and the feedback circuit is connected to a control circuit. Referring to FIG. 2, the control circuit comprises a light adjusting signal source 1, a sampling unit 3, an adjusting unit 8 and a frequency modulation circuit, for adjusting the duty cycle and the frequency to conduct the switch 5, so as to change the output of current to a lamp set 7 to adjust the brightness. The adjusting unit 8 is used for connecting a frequency modulation circuit with the pulse controller 2, and turning on the frequency modulation circuit to produce a voltage reference signal to achieve the purpose of simultaneously controlling frequency modulation and amplitude modulation, and the frequency modulation circuit comprises a frequency limiter 9 and a frequency generator 10; the pulse controller 2 controls the duty cycle of the switch 5, and the duty cycle of the switch 5 determines whether or not to conduct the power source 4 with the transformer 6, and supply power to the lamp set 7 from a secondary side of the transformer 6, such that the lamp set 7 can emit light, and a sampling unit 3 obtains a feedback signal from a secondary side of the transformer 6 that is combined with a brightness setting signal of the light adjusting signal source 1 to form an adjusting signal, and the adjusting signal is received by an adjusting unit 8, and the adjusting unit 8 turns on the frequency modulation circuit and generates the voltage reference signal according to the intensity of the adjusting signal, and the voltage reference signal is inputted to the pulse controller 2 to adjust the pulse controller 2 to output a working cycle. The frequency modulation circuit includes a frequency limiter 9 and a frequency generator 10, and the frequency generator 10 generates a frequency reference signal to produce an operating frequency of the first duty cycle, and the frequency limiter 9 obtains the frequency modulation signal for setting the frequency generator 10 to output a frequency range of the frequency reference signal, such that the present invention has the effect of simultaneously using frequency modulation and amplitude modulation control.

Figure 3:
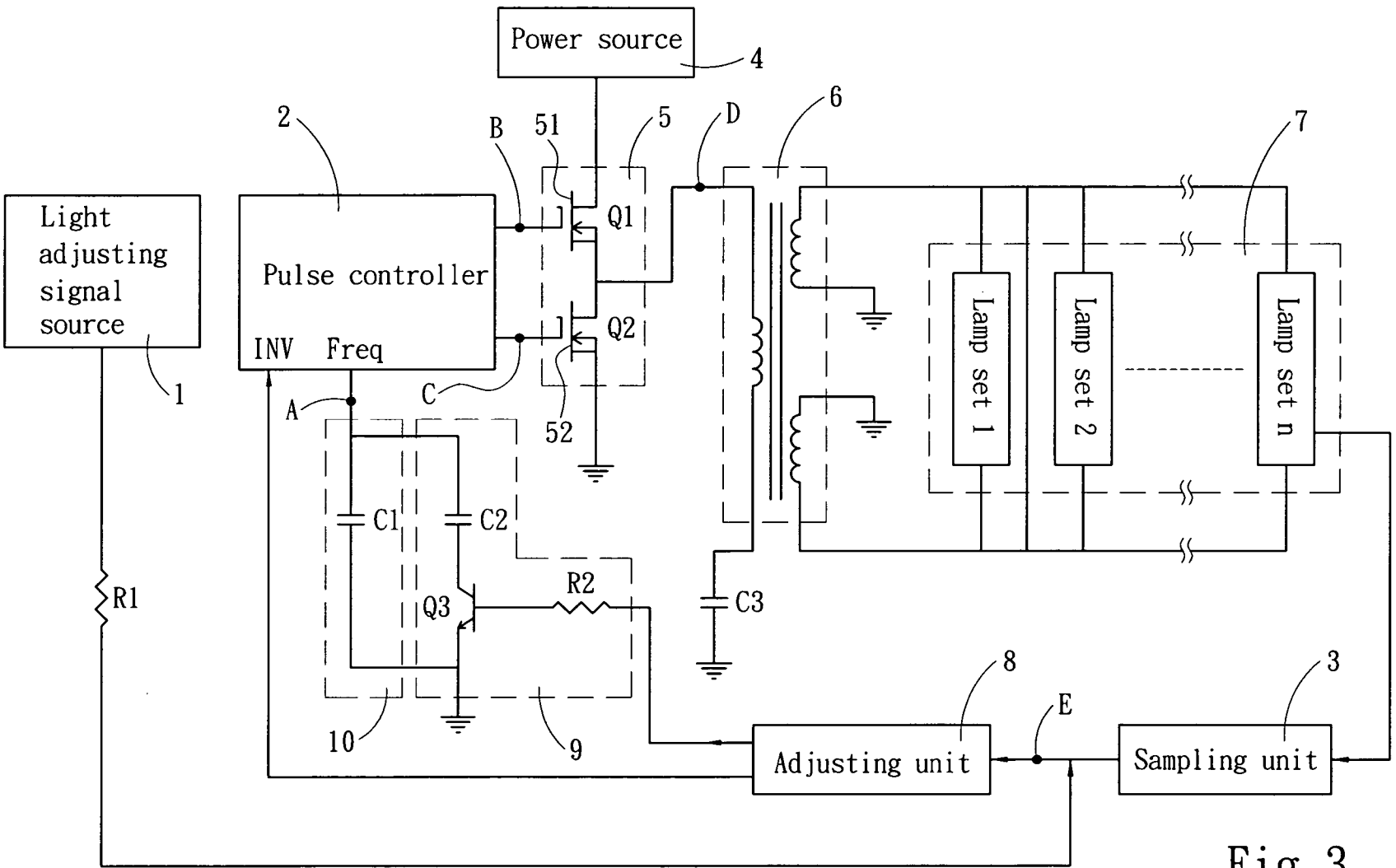
FIG. 3 is a circuit block diagram of a preferred embodiment of the present invention.
Figure 4:
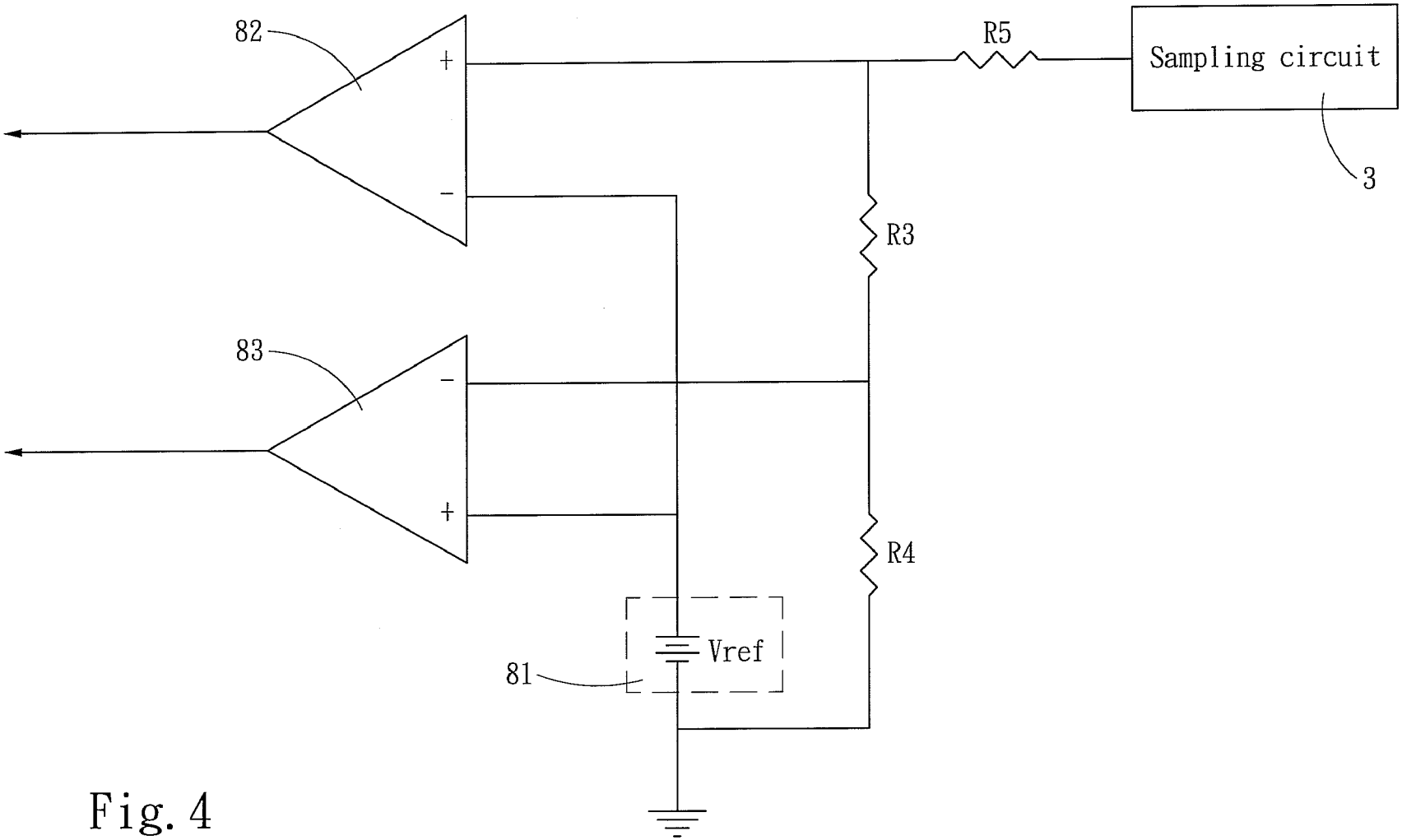
FIG. 4 is a circuit diagram of an adjusting unit of the present invention.

Referring to FIGS. 3 and 4 a circuit block diagram of a preferred embodiment of the present invention and a circuit diagram of an adjusting unit of the present invention, the pulse controller 2 generates a first duty cycle such that when the power of the power source 4 is outputted to the lamp set 7 by the switch 5 and the transformer 6, and the sampling unit 3 obtains a feedback signal from the secondary side of the transformer 6, which is combined with a brightness setting signal for outing a light adjusting signal source 1 into an adjusting signal for outputting the adjusting unit 8. In FIG. 4, the adjusting unit 8 comprises a first comparator 82, a second comparator 83, a standard voltage source 81 and a plurality of resistors, wherein the first comparator 82 and an end of the second comparator 83 input the standard voltage source 81 and output a standard voltage, and another end of the first comparator 82 inputs the adjusting signal to be compared with the standard voltage to output a frequency modulation signal. The adjusting signal uses a resistor R3 and a resistor R4 to divide voltage to be inputted into another end of the second comparator 83. If the divided voltage of the resistor R3 and the resistor R4 is larger than the standard voltage, the second comparator 83 will output a voltage reference signal, and the voltage reference signal affects a duty cycle outputted by the pulse controller 2. Referring to FIG. 3, the frequency modulation signal is sent to the frequency modulation circuit, and the frequency modulation circuit comprises the frequency limiter 9 and the frequency generator 10, and the frequency generator 10 is a capacitor C1 connected to the pulse controller 2, and the capacitor C1 is charged or discharged to produce a frequency reference signal, and the speed of charging or discharging the capacitor C1 forms a reference frequency, and the frequency limiter 9 comprises a capacitor C2, a resistor R2 and a transistor Q3. The frequency limiter 9 uses the impedance of the capacitor C2 to limit the magnitude of current of a collector that passes through the transistor Q3 and operates at a saturating area to form a frequency limit boundary of the frequency generator 9, and a gate of the transistor Q3 is connected to the resistor R2 and the adjusting unit 8, and a collector of the transistor Q3 is connected to the capacitor C2, and the transistor Q3 and the capacitor C2 and the frequency generator 10 are connected in parallel, and the frequency modulation signal controls the magnitude of current of a collector of the transistor Q3, such that the current passing through the capacitor C1 can be reduced due to the divided current of the transistor Q3 and the capacitor C2, so as to change the speed of charging or discharging the capacitor C1 and limit the frequency width of the frequency reference signal, and the frequency reference signal affects the frequency of a duty cycle of the pulse controller 2 to generate a second duty cycle with a frequency different from that of the first duty cycle, Further, the intensity of the frequency modulation signal is too high, such that after the transistor Q3 is saturated, the current of the current of the transistor Q3 stops rising and forms a frequency limit boundary of the frequency reference signal, and the pulse controller 2 uses the frequency reference signal and the voltage reference signal to produce a third duty cycle, and adjust the brightness of the lamp set 7.

Figure 5:
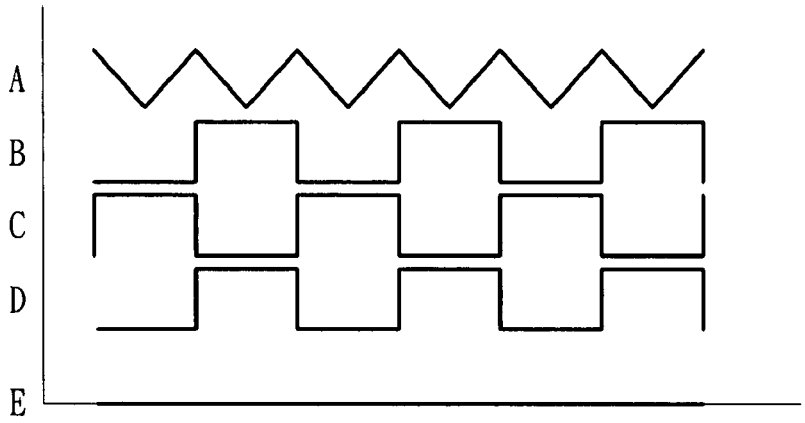
FIG. 5 is a first schematic node voltage diagram of the present invention.
Figure 6:
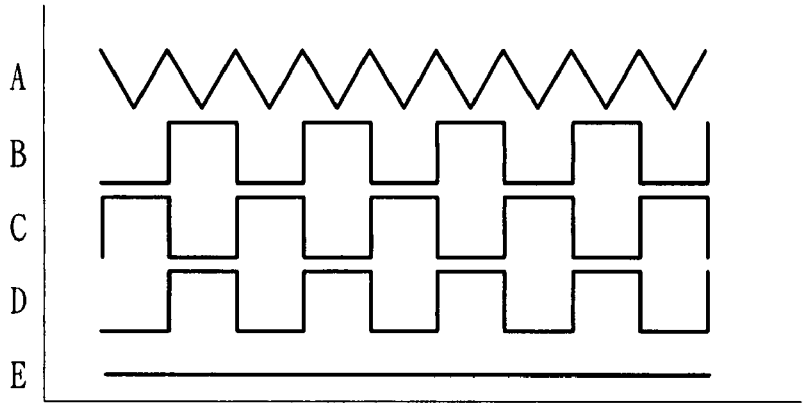
FIG. 6 is a second schematic node voltage diagram of the present invention.
Figure 7:
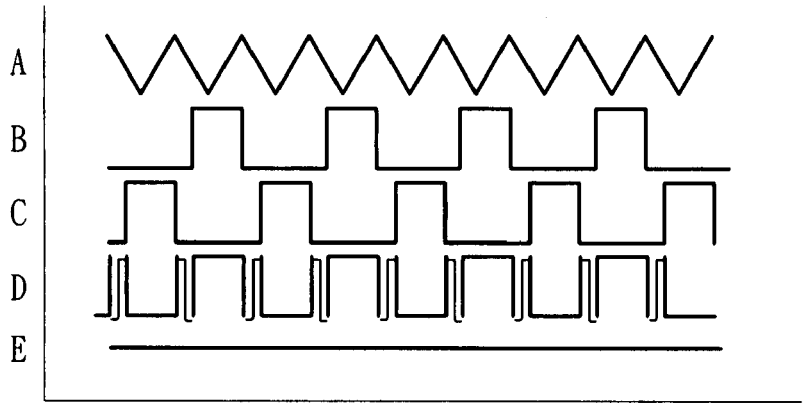
FIG. 7 is a third schematic node voltage diagram of the present invention.

Referring to FIGS. 3 and 5 to 7, FIG. 3 shows a circuit having Nodes A to E, and FIGS. 5 to 7 show a voltage waveform of each node at different operating conditions, wherein Node A is the voltage waveform of the frequency reference signal, and Node E is a voltage waveform of the adjusting signal, and Nodes B and C are the voltage waveforms of the gates of the primary switch 51 and the secondary switch 52 respectively, and Node D is a voltage waveform of the transformer 6. The adjusting signal at E of FIG. 5 is zero, and thus the frequency limiter 9 is operated to drive the frequency generator 10 to generate an initial operating frequency, and the initial operating frequency is a predetermined frequency of the frequency generator 10 minus a predetermined frequency of the frequency limiter 9, and the voltage frequencies at Nodes B and C are equal to the initial operating frequency of the frequency generator 10, and the primary switch 51 and the secondary switch 52 re conducted alternately, and the voltage frequency of Node D at a primary side of the transformer 6 is equal to the voltage frequency of Node B. Since the adjusting signal of Node E as shown in FIG. 6 rises when the feedback signal and the brightness setting signal are combined, therefore the adjusting unit 8 turns off the frequency modulation circuit, and the frequency of the frequency reference signal at Node A rises, and the voltage frequencies of Nodes B, C and D rise accordingly. In FIG. 7, the voltage of the adjusting signal rises further, so that the adjusting unit 8 outputs the voltage reference signal, and the pulse controller 2 changes the outputted duty cycle to shorten the voltage cycle at Nodes B and C significantly and change the voltage waveform passing through the transformer 6. Therefore, the present invention has both frequency modulation and amplitude modulation functions, and can start the frequency modulation and amplitude modulation functions sequentially, so as to achieve the effects of zero voltage switching and adjusting the brightness in an operating frequency of the lamp set 7.

The capacitor C2 of the frequency limiter 9 illustrated in foregoing description and drawings can be changed to a resistor or any other component capable of achieving the effects of dividing current, and limiting frequency, and the transistor Q3 of the frequency limiter 9 can be changed to an operational amplifier (OP) or any other component capable of achieving the amplification effect.

In summation of the description above, the present invention herein enhances over the prior art and further complies with the patent application requirements, and thus is duly applied for the patent application.

While the invention has been described by means of specific embodiments, numerous modifications and variations could be made thereto by those skilled in the art without departing from the scope and spirit of the invention set forth in the claims.

What is claimed is:

1. A power control circuit for adjusting light of a lamp set, which is applied for correcting a duty cycle of an inverter and the inverter comprises a pulse controller for providing a duty cycle, a power source provided for the inverter to adjust the light and power, a switch for determining the connection of the power source by the duty cycle, and a transformer for converting the power source according to the duty cycle to output power to drive a rear-end load, wherein the duty cycle is corrected according to the using status of the transformer or a load feedback power, and a feedback circuit is connected to a control circuit, and the control circuit comprises:

a sampling unit, for obtaining a feedback signal;

a frequency modulation circuit, coupled to the pulse controller, for determining a duty cycle, and the frequency modulation circuit comprising a frequency limiter and a frequency generator, and the frequency generator generates a frequency reference signal to form an operating frequency of a first duty cycle, and the frequency limiter is used for setting a frequency range of the frequency reference signal of the frequency generator;

an adjusting unit, having a standard voltage to be compared with the feedback signal to output a frequency modulation signal to the frequency modulation circuit and determine the frequency range of the frequency reference signal set by the frequency limiter to form a feedback correction, and the pulse controller generates a second duty cycle to adjust the brightness of the lamp set.

2. The power control circuit for adjusting light as recited in claim 1, wherein the adjusting unit is connected to a light adjusting signal source to obtain a brightness setting signal to be combined with the feedback signal to form an adjusting signal and then compared with the standard voltage to output the frequency modulation signal.

3. The power control circuit for adjusting light as recited in claim 2, wherein the adjusting signal drives the reference frequency to a boundary of its frequency range, and the adjusting signal divides voltage to output a voltage reference signal to the pulse controller, such that the pulse controller uses the frequency reference signal and the voltage reference signal to generate a third duty cycle.

4. The power control circuit for adjusting light as recited in claim 2, wherein the adjusting unit comprises a first comparator, a second comparator, a standard voltage source and a plurality of resistors, and an end of the two comparators inputs a standard voltage source to output a standard voltage, and the plurality of resistors divide voltage to input the adjusting signal to another end of the two comparators that is compared with the standard voltage, and outputs a frequency modulation signal from the first comparator, and the second comparator outputs a voltage reference signal.

5. The power control circuit for adjusting light as recited in claim 4, wherein the second comparator has an input with its voltage divided by the adjusting signal, and another input is the standard voltage, such that when the divided voltage of the adjusting signal is less than the standard voltage, the second comparator outputs a low electric potential.

6. The power control circuit for adjusting light as recited in claim 1, wherein the frequency generator has at least one capacitor connected to the pulse controller in series, and the capacitor is charged or discharged to form the frequency reference signal.

7. The power control circuit for adjusting light as recited in claim 1, wherein the frequency limiter comprises a transistor, a resistor connected in series between a base electrode of the transistor and the adjusting unit, and the frequency generator connected in parallel with a capacitor, and the capacitor is connected to a collector of the transistor, and the intensity of the frequency modulation signal controls the connection with the transistor and affects a magnitude of current passing through the capacitor, so as to divide the current of the frequency generator to limit a frequency width range of the frequency generator to generate the frequency reference signal.

8. The power control circuit for adjusting light as recited in claim 7, wherein when the frequency limiter limits a magnitude of current passing through the transistor and working in a saturated area by an impedance of the capacitor of the collector, a frequency limit boundary of the frequency generator is formed.

9. The power control circuit for Adjusting light as recited in claim 1, wherein the frequency limiter comprises a transistor, a resistor connected in series between a base electrode of the transistor and the adjusting unit, and a capacitor connected in parallel with the frequency generator, and the capacitor is connected to a collector of the transistor, and a magnitude of the frequency modulation signal controls an electric connection with the transistor to affect a magnitude of current passing through the capacitor, so as to divide current of the frequency generator to limit a range of the frequency reference signal generated by the frequency generator.

* * * * *